United States Patent [19]

Schaffar et al.

[11] 4,396,182

[45] Aug. 2, 1983

[54] LANCE FOR BLOWING AN OXYDIZING GAS, ESPECIALLY OXYGEN, ONTO A BATH OF MOLTEN METAL

[75] Inventors: Bernard Schaffar, Metz; Hugues Zanetta, St-Julien-les-Metz, both of France

[73] Assignee: Institut de Recherches de la Siderurgi Francaise, German-en-Laye, France

[21] Appl. No.: 330,770

[22] Filed: Dec. 14, 1981

[30] Foreign Application Priority Data

Dec. 22, 1980 [FR] France ..... 80 27410

[51] Int. Cl.[3] ..... C21B 7/16

[52] U.S. Cl. ..... 266/265; 75/60; 266/225; 266/270

[58] Field of Search ..... 266/265, 225, 270; 75/60

[56] References Cited

U.S. PATENT DOCUMENTS

| | | | |
|---|---|---|---|
| 3,427,151 | 2/1969 | Koudelka | 266/225 |
| 3,519,259 | 7/1970 | Death | 266/225 |
| 3,642,060 | 2/1972 | Hlinka | 266/225 |
| 3,653,877 | 4/1972 | Enya | 266/225 |
| 4,230,274 | 10/1980 | Rymarchyk | 266/225 |
| 4,301,969 | 11/1981 | Sharp | 266/225 |

*Primary Examiner*—P. D. Rosenberg

*Attorney, Agent, or Firm*—Michael J. Striker

[57] ABSTRACT

A lance for blowing an oxydizing gas onto a bath of molten metal, especially for blowing oxygen on a bath of molten pig iron for transforming the same into steel. The lance is provided in an end wall of its nose with at least one central aperture for blowing gas jets at great impulsion onto the bath and a plurality of auxiliary apertures for blowing gas streams of considerably smaller impulsion onto the bath. The auxiliary apertures are constituted by elongated slots through the end wall arranged spaced from each other along a circle at a distance of adjacent edges of the slots and that at least one main aperture of about 2–20 cm. This construction permits to improve the amount of secondary combustion of the reaction gas while prolonging the useful life of the nose of the lance. The lance is advantageously used in conjunction with blowing a stirring gas through the bath of molten metal through refractory gas permeable elements provided in the bottom of a crucible containing the bath.

5 Claims, 3 Drawing Figures

LANCE FOR BLOWING AN OXYDIZING GAS, ESPECIALLY OXYGEN, ONTO A BATH OF MOLTEN METAL

BACKGROUND OF THE INVENTION

The present invention relates to a lance for blowing an oxidizing gas, especially oxygen, onto a bath of molten metal in a crucible for metalurgically treating the molten metal, especially for refining pig iron into steel.

More precisely, the invention relates to a blowing lance, the nose of which comprises in addition to the usual main apertures opening at the front face of the tip of the the lance and serving to blow oxygen in form of jets of great impulsion for the refining of the metal (oxidation of impurities of the metal bath), a plurality of auxiliary apertures for blowing oxygen streams of lesser speed onto the bath in order to improve the rate of secondary combustion of the refining gas.

The "nose" of the lance constitutes its end through which the refining gas passes toward the bath of metal. Generally, the "nose" is a piece of curved copper connected to the end of the lance.

The "front face" is the part of the nose which is directed toward the metalic bath contained in the crucible.

It is also mentioned that the rate of the secondary combustion is expressed in the proportion of $CO_2$ in the reaction gas, which $CO_2$ is obtained by the oxydation of CO which emanates from the metalic bath following the decarburization of the latter by the oxygen refining.

Multivallent lances of this type already exist. However, improvement of these lances is still possible, especially with respect to increase the secondary combustion of the gas of the reaction, as well as to improve the durability of the nose of the lance.

SUMMARY OF THE INVENTION

It is an object of the present invention to provide a lance for blowing an oxidizing gas onto a bath of molten metal which is improved with respect to such lances according to the prior art, especially with regard to increase the secondary combustion of the reaction gas and to improve the durability of the nose of the lance.

With these and other objects in view, which will become apparent as the description proceeds, the object of the present invention is to provide a lance for blowing an oxidizing gas, especially oxygen, onto a bath of molten metal, especially a bath of pig iron, for refining the same into steel, in which the nose of the lance is provided with two categories of apertures, that is main apertures opening at the front face of the nose and serving for blowing oxygen at great impulsion onto the bath, and auxiliary apertures for blowing oxygen streams of small speed onto the bath, in which these auxiliary apertures are constituted by elongated slots arranged spaced from each other in the direction of their elongation along a circle about the central apertures at a distance of adjacent edges of said slots and the central apertures of about 2–20 cm.

The main idea on which the invention is based is to create at the outlet of the lance a continuous sheet of oxygen which expands in the form of an "umbrella" around the principal jets while being directed toward metalic bath.

For this purpose it is judicious that these auxiliary apertures are not in the form of circular openings, but to the contrary in the form of elongated slots arranged in a circle spaced from each other about the main apertures. The invention results from the following essential considerations:

In order to obtain an increased secondary rate of combustion, it is necessary that the oxygen streams which create the necessary oxydizing atmosphere are as close as possible, after their issue from the lance, not confined in localized jets around the axis of the openings, but contrary thereto spread laterally as much as possible. The jets reunite at a short distance from the lance to quickly form a conical gaseous sheet having its center at the nose of the lance and encircling the principle jets in covering the bath of molten metal. Under this condition a screen of oxygen is formed above the bath which the $CO_2$ emanating from the bath must traverse.

It is also mentioned that practically the noses of all known lances wear out, especially between the main apertures, despite the efforts to increase the efficiency of the cooling of the nose by internal circulation of water. In their research, the inventors have established that wear results mainly from the phenomenon of aspiration provoking a gaseous recirculation around the oxygen jets of great impulsion. Thus, the very hot gases present in the atmosphere above the metal bath and charged with solid particles are locally sucked up against the lance to thereby erode the surface of the nose around the main apertures and especially the zones between these main apertures.

Due to the presence of auxiliary apertures in the form of slots, in accordance with the present invention, the flow of gas against the nose of the lance is favorably modified in such a manner that the phenomenon of wear by recirculation of the hot gas is considerably reduced.

In accordance with the present invention, such a result is obtained if the slots are spaced from the main apertures by a distance of about 2–20 cm as measured between adjacent edges of slots and main apertures.

If the slots are located too close, that is less than 2 cm to the main apertures, the gases recirculation around the principle jets is certainly repressed, but the oxygen streams emanating from the slots are accelerated due to their entrainment by the principal jets so that in the end result, the problem of wear, will occur around the secondary slots. Furthermore, this consideration acts in opposition to the lateral diffusion of the secondary currents, so that, in most of the cases, the formation of a homogeneous conical oxygen sheet above the metal bath is retarded and the secondary combustion penalized.

On the other hand, if the slots are placed too far, that is more than about 20 cm, from the central aperatures, they will have practically no influence on the aerodynamics at the vicinity of the principal oxygen jets. Of course, the secondary slots may not be placed on the vertical wall of the nose since in this case the desired effect will not be obtained.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
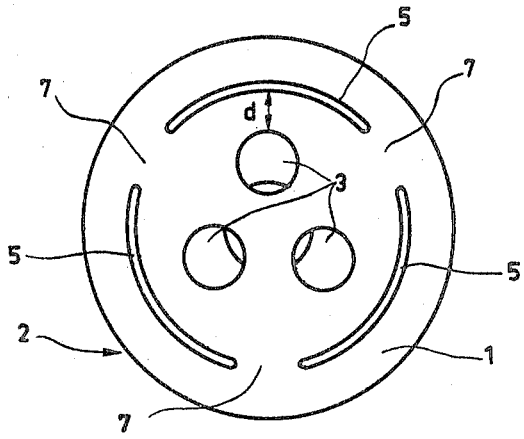
FIG. 1 schematically illustrates the bottom view of a first embodiment of a nose of a lance according to the present invention.
Figure 2:
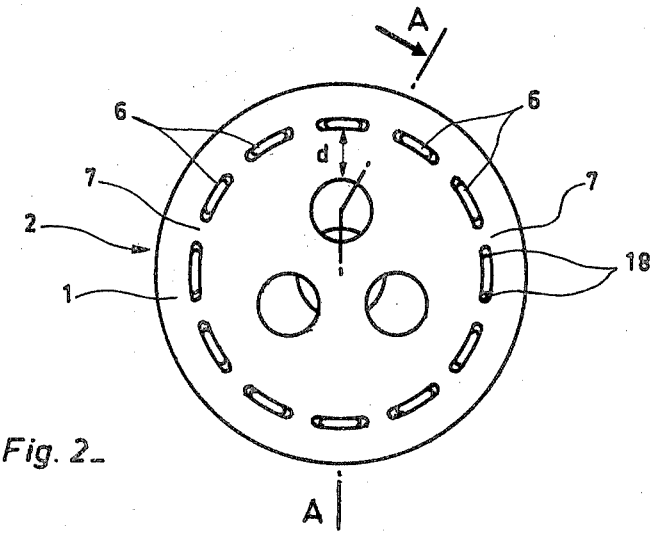
FIG. 2 schematically illustrates the bottom view of a second embodiment of a nose of a lance according to the present invention.

In FIGS. 1 and 2, the reference numeral 1 designates the front face of a lance 2. This front face, which is substantially planar or slightly curved, is provided in its central region with three main apertures 3 for the blowing of oxygen jets at great impulsion onto a bath of molten metal, not shown in the drawing. The centers of the three apertures 3 are located preferably at the corners of an imaginary equilateral triangle.

At a distance d, which is about 2–20 cm from the edge of the orifices 3, a plurality of aperture for the discharge of oxygen streams of small impulsion are arranged for the purpose to form a continuous conical sheet surrounding the principal jets and covering the surface of the bath of molten metal which is to be refined.

In accordance with the present invention, these auxiliary apertures may be formed in many different ways, starting from a plurality of short practically rectilinear slots 6 (FIG. 2) to pass over to more or less elongated slots in the form of circular arcs, thus as shown at 5 in FIG. 1.

It is to emphasized that the desired conical gas screen may be realized by means of a succession of spaced slots, as shown in FIGS. 1 and 2. This form of construction has the purpose to provide between the slots bridges 7 which facilitate the provision of a circuit of cooling water in the interior of the nose of the lance. In this case it is advantageous to provide the slots with divergent profiles in the direction of blowing to permit a better lateral diffusion of the different secondary oxygen currents which thus may join quickly after their issue from the slots so as to form as quickly as possible the desired uniform gaseous screen. For this purpose the small end faces of the slots are chamfered, which chamfers are clearly visible at 18 in FIG. 2.

Figure 3:
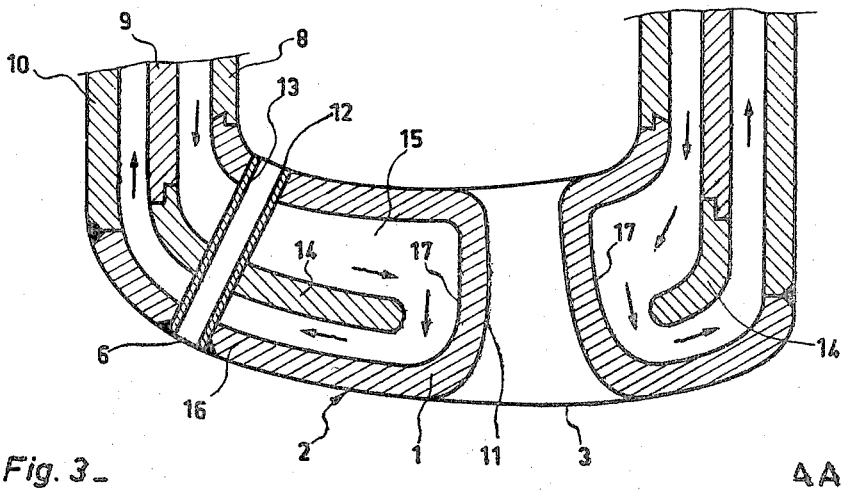
FIG. 3 is a vertical cross-section taken along the line A—A of FIG. 2.

FIG. 3 illustrates a nose of the lance 2 in a vertical cross-section which is provided at the bottom end of the lance, which is constituted in the usual manner by three concentric tubes 8, 9 and 10. The nose 2 is a hollow piece of copper cast in a manner to provide central passages 11 which open at the front face 1 at apertures 3 already mentioned. The copper piece is further pierced by machining and copper tubes 12 are placed into the realized openings. The tubes 12 present in a cross-section, transverse to their elongation, passages 13 of oblong form and open in the front face 1 in form of the slots 6.

An internal partition 14, which may integrally molded with the nose, divides the interior of the nose into two compartments, an inner compartment 15 and an outer compartment 16, communicating with each other by an annular passage 17 provided around the principal passages 11. In this way is a fluidtight circuit of cooling water is provided in the interior of the nose which efficiently irrigates the whole of the front face 1. The circulation of the cooling water is indicated in FIG. 3 by the arrows.

It is evident that in order to practice the present invention it is necessary to provide means which permits to differentiate the blowing speed of oxygen between the principal jets at high impulsion for the refining and the secondary jets of considerably smaller speed of movement destined to form the gaseous screen.

These means may be strictly constructive, the relative caliber of the passages 13 assuring the distribution of the output, or they may be more elaborated to permit the dynamic regulation and being independent from the outflow of gas, for example, providing two separate supplies of oxygen and the body of the lance with two flow passages.

The lance of the present invention may be used for any treatment with oxygen of a carburized bath of molten metal contained in a metalurgical container. Preferably the invention is co-jointly used with a mixing or stirring operation of the bath obtained by blowing into the latter a stirring gas (preferably a neutral gas or eventually an oxydizing gas) through tuyeres or a gas permeable refractory element incorporated in the wall of the container at a level below the upper bath surface, and especially in the bottom wall of the container. It is in this way that the best result at the plane of the secondary combustion are obtained, especially for the reason that the pneumatic stirring of the bath by blowing a gas from the bottom will stabilize the height of the layer of slag and likewise the distance separating the bottom of the lance from the surface of the slag.

It will be understood that each of the elements described above, or two or more together, may also find a useful application in other types of lances for blowing an oxydizing gas onto a bath of molten metal differing from the types described above.

While the invention has been illustrated and described as embodied in a lance for blowing an oxydizing gas onto the bath of molten metal and provided in the end face of the noxe of the lance with at least one main aperture for blowing gas jets of great impulsion onto the bath surface and a plurality of auxiliary apertures constituted by slots arranged spaced from each other along a circle about the central aperture for blowing through the slots gas streams of considerably smaller impulsion onto the bath surface, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A lance for blowing an oxidizing gas, especially oxygen, onto a bath of molten metal, especially for the refining of pig iron into steel, said lance having a nose portion including end wall means having an outer end face and being provided with first means for blowing gas jets at great impulsion onto said bath, said first means comprising at least one main aperture in said end wall means and opening at a central region of said outer end face; and second means for blowing gas streams of considerably smaller impulsion onto the bath, said second means being constituted by a plurality of elongated slots arranged spaced from each other through distances considerably smaller than their length and extending in the direction of their elongation along a circle about said at least one central aperture with adjacent edges of said slots and said at least one aperture spaced about 2–20 centimeters from each other, said elongated slots opening likewise at said end face to form an umbrella of oxidizing gas around the gas jets of great impulsion passing through said at least one central aperture.

2. A lance as defined in claim 1, wherein each of said slots has a cross section diverging in the direction of the gas flowing therethrough.

3. A lance as defined in claim 2, wherein the small end faces of said slots are chamfered.

4. A lance as defined in claim 1, wherein three main apertures are provided in the central region of said end face with the centers of the three apertures arranged at the corners of an imaginery equilateral triangle.

5. A lance as defined in claim 1, wherein said end wall means are provided with channels for the passage of cooling fluid therethrough.

* * * * *